United States Patent [19]

Thaler

[11] Patent Number: 4,973,657

[45] Date of Patent: Nov. 27, 1990

[54] HIGH-STRENGTH POLYESTER YARN AND PROCESS FOR ITS PREPARATION

[75] Inventor: Hans Thaler, Bobingen, Fed. Rep. of Germany

[73] Assignee: Hoechst Aktiengesellschaft, Fed. Rep. of Germany

[21] Appl. No.: 770,623

[22] Filed: Aug. 28, 1985

[30] Foreign Application Priority Data

Aug. 30, 1984 [DE] Fed. Rep. of Germany ..... 3431831

[51] Int. Cl.[5] ..... B29K 67/00; D01F 6/00; D02J 1/22; B29C 55/00

[52] U.S. Cl. ..... 528/308.1; 264/210.6; 264/210.8; 264/211.17; 428/364; 428/902

[58] Field of Search ..... 264/210.6, 210.8, 211.17; 428/364, 902; 528/308.1

[56] References Cited

U.S. PATENT DOCUMENTS

| | | | |
|---|---|---|---|
| 4,195,052 | 3/1980 | Davis et al. | 264/210.8 |
| 4,251,481 | 2/1981 | Hamlyn | 264/210.8 |
| 4,369,155 | 1/1983 | Schiso et al. | 264/210.8 |
| 4,414,169 | 11/1983 | McClary | 264/210.8 |
| 4,456,575 | 6/1984 | Smith et al. | 264/211.17 |
| 4,491,657 | 1/1985 | Saito et al. | 264/210.8 |
| 4,496,505 | 6/1985 | Tanji et al. | 264/211.17 |
| 4,743,504 | 5/1988 | Carr | 264/210.8 |

FOREIGN PATENT DOCUMENTS

| | | |
|---|---|---|
| 80906 | 6/1983 | European Pat. Off. . |
| 89912 | 9/1983 | European Pat. Off. . |
| 1288734 | 2/1969 | Fed. Rep. of Germany . |
| 2207849 | 8/1973 | Fed. Rep. of Germany . |
| 2254998 | 7/1975 | Fed. Rep. of Germany . |
| 2747690 | 4/1978 | Fed. Rep. of Germany . |
| 51-53019 | 5/1976 | Japan . |
| 58-46117 | 3/1983 | Japan . |
| 58-23914 | 5/1983 | Japan . |

OTHER PUBLICATIONS

Sowj. Beiträge Für Faserforsch. u. Textiltechnik 1971 S. 521–524.

Pahshoer, Khimicheskie Volokna, 1983, 1, 59–61.

Faserforsch. und Textiltechn. 28, (1977), 296–301.

*Primary Examiner*—James C. Cannon

*Attorney, Agent, or Firm*—Connolly & Hutz

[57] ABSTRACT

The invention relates to a high-strength polyester yarn having a heat shrinkage at 200° C. of less than 7%, a degree of elasticity $ED_{20}$ of at least 90%, a stability quotient SQ of at least 7.5 and a crystallinity of about 57% to 65%. Such yarns can be obtained by high-speed pinning of filaments which have at least a birefringence of 0.025 and an average molecular weight corresponding to a relative viscosity of 1.9 to 2.2 and are subjected to a stretching at high temperatures using a stretch ratio of at least 90% of the maximum cold stretch ratio and a stretching tension between 19 and 23 cN/tex.

7 Claims, 3 Drawing Sheets

HIGH-STRENGTH POLYESTER YARN AND PROCESS FOR ITS PREPARATION

The present invention relates to a high-strength, low-shrinkage polyester yarn for industrial use, i.e. for use in particular in the form of twisted, woven and braided structures etc. as strength components in industrial products such as tarpaulins, tires, drive belts, conveyor belts etc., and to a process for preparing such yarns from highly preoriented filaments.

Figure 1:
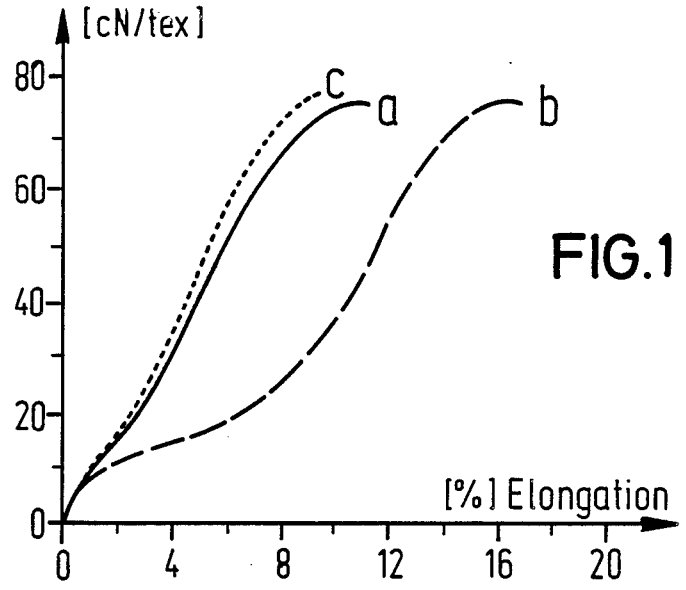
FIG. 1 depicts the course of stress-strain diagrams for (1) prior art high heat shrinkage polyester tire cord yarn produced from very low molecular orientation filaments later subjected to high stretch (curve a), (2) said yarn after having been subjected to a thermomechanical heat shrink process (curve b having a characteristic "shrinkage saddle"), and (3) polyester yarn of the instant invention.

The preparation of high-strength yarns from polyester filaments is known. According to German Auslegeschrift 1,288,734, the spinning conditions for this purpose need to be such that the tensions acting on the solidifying filament are extremely low and that the filament is consequently distinguished by a very low molecular orientation. Birefringence values of less than 0.003, preferably even less than 0.002, are required. If such filaments are later subjected to a high stretch, the products which can be obtained are yarns of high strength. The course of the stress-strain curve of a polyethylene terephthalate yarn for preparing tire cord having a denier or count of 1100 dtex is shown as curve a in FIG. 1. The tenacity of this material is about 76 cN/tex with an elongation at break of 11%. However, such a yarn still has a high heat shrinkage, for example of about 18% in a hot air treatment at 200° C. The determination of heat shrinkage at 200° C. has become customary, since in general 200° C. is the highest temperature which can arise in the coating of sheetlike structures made of such yarns. A yarn material which still has a shrinkage of for example 18% undergoes excessive and uncontrollable dimensional changes in such a coating process. It is therefore necessary to reduce the heat shrinkage $S_{200}$ from the abovementioned 18%. This is effected in conventional manner by thermomechanical shrink processes in which the yarns are shrunk under controlled tension. In this way it is possible for example to reduce the heat shrinkage at 200° C. $S_{200}$ to for example 5%. However, this measure is inevitably associated with an increase in maximum elongation to for example 16% and a decrease in tenacity from for example 76 cN/tex to 72 cN/tex.

The values of maximum tensile force extension and maximum tensile force are not suitable for adequately characterizing the properties of such a yarn. The changes which can result in the physical properties after a shrinking are shown with curve b in the stress-strain diagram of FIG. 1. This curve represents the measurement on a commercially available yarn of low shrinkage. Said curve b of FIG. 1 clearly shows the formation of the so-called "shrinkage saddle".

The demand for a high initial modulus, low extension, high degree of elasticity and low shrinkage is thus difficult to meet, since all necessary thermomechanical measures for reducing heat shrinkage at the same time also reduce tenacity and cause impairment of the mechanical properties, such as maximum tensile force extension, initial modulus and degree of elasticity. Hitherto it was therefore necessary to adopt a compromise by using fully shrunk material which, in order to achieve the desired values which determine dimensional stability, such as degree of elasticity and initial modulus, had to be considerably overdimensioned. The teaching of German Auslegeschrift 1,288,734 inevitably also requires low spinning takeoff speeds, since it is only under these conditions that the required low tension values on the freshly spun filaments can be realized. However, a low spinning takeoff speed also means a lower output per spinneret. It is known that output per spinneret increases strongly with increasing spinning takeoff speed, as depicted for example in FIG. 1 of German Offenlegungsschrift 2,207,849. Attempts at producing high-strength yarns through high-speedspinning alone have hitherto all failed because of the low strength and the high elongation at break of yarns prepared in this way, which were described for the first time in U.S. Pat. No. 2,604,667.

German Auslegeschrift 2,254,998 describes a process which comprises first doubling and twisting high-speed filaments and then subsequently stretching the resulting cord yarn. The necessary high twisting of the cord yarn before stretching is expensive to impart, and the process is excessively prone to breakdown and therefore has been unable to attain practical importance.

German Offenlegungsschrift 2,747,690 describes a multistage process comprising spin stretching and a subsequent plurality of separate stretching stages. The spin takeoff speed from the jet is supposed to be between 500 and 3000 m/min, although the examples only describe a range from 500 to a maximum of 1300 m/min, so that the German Auslegeschrift 2,207,849 prediction of higher output for higher takeoff speeds does not come to bear. The filaments prepared in this uneconomical manner admittedly show improvements over the previously disclosed high-strength polyester filaments in thermostability, but they have the great disadvantage of a relatively low stability to the action of hot water or chemicals. This disadvantage which has already been mentioned in European Patent Application No. 0,080,906 and in Japanese Patent Application Sho-58-23,914, is likewise due to the low degree of crystallinity claimed in the patent application, since chemicals are significantly more likely to have an effect on amorphous polyethylene terephthalate than on crystalline polyethylene terephthalate. As is clear from the examples, the process is only suitable for fine deniers, which increases the sensitivity to chemicals even further.

European Patent Application No. 0,089,912 likewise features a high windup speed of above 1500 m/min. The application describes a process with which, through modification of the previously used spinning conditions, a high takeoff speed is used to obtain a filament which has high strength values after stretching. Although this patent application provides no information about the thermomechanical properties of the stretched filaments, it is likely, from the combined stretching and twisting process used, that the shrinkage values will inevitably be very high. As will be mentioned later, the dwell times in the stretching zone are much too short for substantial stabilization.

Japanese Patent Application Sho-51-53,019 reveals that stretched polyester filaments having a birefringence value of 0.03 or higher can be stretched to give high-strength filaments which are then subsequently subjected to a shrinkage treatment also. The yarns thus obtained, it is true, have a heat shrinkage at 150° C. of less than 2.5%, but their elongations at break are above 15%, usually within the range between 16 and 22%. It can be demonstrated on the basis of the high elongation at break alone that these filaments or yarns have a "shrinkage saddle", as indicated in curve b of FIG. 1.

In Japanese Patent Application Sho-58-46,117, preoriented filaments which have a certain minimum crystallinity are likewise to be subjected to stretching at at least 85° C. Despite the use of two-stage stretching in all illustrative embodiments of the invention, the physical values of the filaments or yarns thus obtained are relatively poor. These yarns are only intended for fields of use in which the manufacture of the completed article is preceded by a thermal treatment. The patent application mentions the dip process, customary with tire cord yarns, for thermofixing and curing the resorcinol/formaldehyde/latex finish. The present invention, on the other hand, is directed toward high-strength, low-shrinkage and low-extension polyester filaments for all industrial fields of use.

In Japanese Patent Application Sho 58-23,914, the filaments obtained likewise only have a heat shrinkage at 175° of 7.0 to 10.0%, their heat shrinkage at 200° C. being correspondingly higher. European Patent Application No. 0,080,906 of the same applicant likewise describes a process in which core-sheath differences within the filaments are to be avoided. The heat shrinkage of the freshly obtained filaments is likewise too high. These filaments accordingly likewise do not meet the requirements of the present invention, since the production of low shrinkage values likewise requires a subsequent thermal treatment of the type mentioned in Japanese Application No. Sho-46,117 to be carried out. This treatment is the dip process likewise mentioned in the two patent applications. A test—the treatment of a stretched yarn at 240° C. for 1 minute—is supposed to imitate the dip process and show that this treatment can be used to reduce the originally excessively high shrinkage of the yarn.

There was thus still an unmet demand for high-strength polyester yarns whose heat shrinkage at 200° C. is as low as possible and which, moreover, have no "shrinkage saddle" in their stress-strain curve, i.e. whose elastic properties ideally correspond to those of unshrunk filaments.

It has now been found, surprisingly, that it is possible to provide such high-strength polyester yarns. These untwisted yarns have a heat shrinkage at 200° C. of less than 7%, a degree of elasticity under a load of 20 cN/tex of at least 90% and a stability quotient SQ of at least 7.5. The stability quotient SQ used to define the yarns according to the invention is a dimensionless parameter. It is calculated by the following formula $$\text{Stability quotient } SQ = \frac{ED_{20}}{S_{200} + D_{54}}$$

$ED_{20}$, as already defined above, is to be understood as meaning the degree of elasticity under a load of 20 cN/tex; $S_{200}$ is the heat shrinkage in percent at 200° C.; and $D_{54}$ is the reference extension under a load of 54 cN/tex. The course of the stress-strain diagram of the yarns according to the invention is represented by curve C in FIG. 1.

The crystallinity of the individual filaments is 56 to about 65%. The yarns are preferably comprised of polyethylene terephthalate, although the filament-forming substance may contain up to 2% by weight of other comonomer units. Yarns having a heat shrinkage $S_{200}$ of less than preferably less than 2%, are preferred. As are yarns which have a crystallinity of 60% to 63%, the crystallinity being calculated from the density of the filaments, according to the following equation $$\text{Crystallinity } (\%) = \frac{d_k \cdot (d - d_a)}{d \cdot (d_k - d_a)}.$$

The density d of the filaments can be determined by means of a gradient column. The density of the amorphous region $d_a$ has been set at 1.335 g/ml and the density of the crystalline material $d_k$ at 1.455 g/ml.

These yarns are prepared according to the invention by stretching polyester yarns which have a preorientation corresponding to a birefringence of at least 0.025 and an average molecular weight corresponding to a relative solution viscosity of about 1.9 to 2.2. Such filaments are subjected to a hot stretch in which the stretching ratio used is at least 90% of the maximum cold stretching ratio, and the stretching tension in this stretch under the chosen conditions is between 19 and 23 cN/tex. The preferred range for this stretching tension is 20 to 23 cN/tex.

Untwisted yarns have little or no protective torque; 1100-dtex yarns commonly have for example 60 turns per meter. These yarns are either used directly as strength components, for example in coating fabrics, or serve as starting materials for twist yarns, for example in tire construction.

High-strength yarns usually have tenacities of above 65 cN/tex. The heat shrinkage $S_{200}$ is according to DIN 53,866 the relative change of the length of a yarn which has been freely shrunk at 200° C. air temperature for 10 minutes.

The degree of elasticity $ED_{20}$ is determined in accordance with DIN 53,835, which involves placing the yarn in a tensile tester where it is put under a load up to a fixed force limit and is then allowed to recover in full. The figures noted are the total extension at the defined load limit ($\epsilon_{tot}$) and the remaining residual extension ($\epsilon_{res}$) after the yarn has recovered. A measure of the elastic proper-ties is the elastic extension ratio (ED) or degree of elasticity, which can be calculated by the formula $$ED\ (\%) = \frac{\epsilon_{tot} - \epsilon_{res}}{\epsilon_{tot}} \times 100$$

Figure 2:
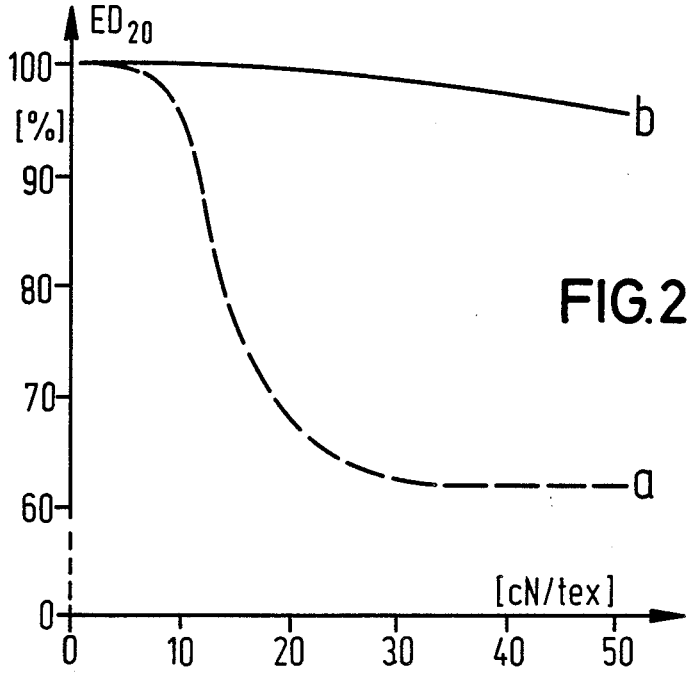
FIG. 2 compares dependence on the applied load of the degree of elasticity of prior art low shrink yarn (curve a) with yarn of the instant invention (curve b).

FIG. 2 shows the dependence of the degree of elasticity on the applied load in the case of a commercially available low-shrink yarn (curve a). In this curve there is an abrupt decrease in the degree of elasticity from about 10 cN/tex. For the purposes of this patent specification, the elastic properties are described by means of the degree of elasticity under a load of 20 cN/tex, this degree of elasticity being designated $ED_{20}$. In the case of the yarns according to the invention, on the other hand, the dependence is found to be as in curve b of FIG. 2.

The reference extension $D_{54}$ likewise serves in this application to characterize the mechanical properties of the yarn according to the invention. $D_{54}$ is the value of the extension under a load of 54 cN/tex. The load value of 54 cN was chosen arbitrarily. It roughly corresponds to 75% of the tenacity of these yarns and likewise permits satisfactory statements about the elastic properties of the yarns, but in particular as to whether or not a "shrinkage saddle" is present in the stress-strain diagram of the yarn studied. Of course, the reproduction of the complete stress-strain diagram provides the best indication of the mechanical properties of a yarn under study, but comparisons are better made on the basis of numerical values.

For that reason, this diagram is frequently presented in the literature in the form of individual points therefrom. The values most commonly quoted are the maximum tensile force and the maximum tensile force extension. As previously stated above, these values are not very meaningful in the case of high-strength filaments, in particular if the filaments have been shrunk. As is known, the elongation at break for example decreases with increasing stretching ratio, but increases again if shrinkage is subsequently allowed in a thermomechanical process. It is accordingly impossible to judge from the value for the maximum tensile force extension whether it is due to a high degree of stretching with subsequent allowed shrinkage or a low degree of stretching with less or no allowed shrinkage. Moreover, faulty filaments have lower break strengths and hence also lower elongations at break. To characterize the extension properties of a filament it is therefore better to select a point within a stress-strain diagram region which is not made unreliable by such factors. In the present case, the reference extension $D_{54}$ has been chosen for the purpose of characterization. Nor is the initial modulus (also referred to as Young modulus) which is mainly found in the English-language literature and which indicates the slope of the stress-strain line in its initial range very suitable for characterizing high-strength fibers. However, inferences about the entire operating range of the filaments from the initial modulus is possible only for stretched filaments and not for shrunk filaments. As can be seen, for example from curve b of FIG. 1, the stress-strain diagram changes in characteristic fashion in the case of shrunk filaments. An initially identical gradient for curves a and b, i.e. an identical initial modulus, is followed by a section in which curve b flattens out to a certain extent from about 10 cN/tex and then increases again for high loads and high extension values. The most meaningful statements for practical use can be made on the basis of the extension value associated with a point in the stress-strain diagram which is above the shrinkage saddle but still clearly enough below the elongation at break.

It has been found that it is possible to use a simple and economical process to prepare high-strength, thermally and dimensionally stable and highly elastic filaments which produce the desired properties even without further thermal aftertreatment of the textiles prepared therefrom and which are valuable for many fields of use.

The essential element in obtaining the claimed filament properties is a stretching process as described hereinafter, which can only be carried out on highly preoriented spun material.

Stretching processes are usually defined in terms of stretching ratios and stretching temperatures. In this case the stretching process according to the invention is not being characterized in terms of the widely used concept of "stretching temperature", since such specifications can hardly be reproduced by third parties without considerable error, even if data are provided at the same time about the dwell time in the stretching zone. It is practically impossible to indicate the effective yarn temperature inside a heater.

In this text, a minimum stretching ratio and a range for the stretching tension to be obtained have instead been defined.

The maintenance of an adequate dwell time for filaments on a heater is of particular importance especially in the case of high-denier filaments for industrial use. The effect which the heat transfer can have is shown for example by Aleksandriskii (Sowjet. Beiträge zu Faserforschung und Textiltechnik 1971, page 521). If the heat is transferred by way of hot metal surfaces, such as, for example, hot rolls, in the case of a linear density of 1100 dtex, the dwell time should be at least 0.5 second in order to obtain constant shrinkage in the stabilization of stretched filaments. If the heat is transferred through hot air (by convection), the dwell time should be at least 3 seconds (Pakshver, Khimicheskie Volokna, 1983, 1, pages 59–61). In the case of high-speed combined spinning and stretching processes of the type described for example in European Patent Application No. 80,906, a dwell time of 0.5 second would require for example for a filament speed of 5000 m/min a contact length of the filaments with the hot roll of 71.7 m. In the case of the customary tenfold wrap of a hot godet having a diameter of 20 cm, as is customary in commercial combined spinning and stretching units, it is possible to calculate a contact length of less than 6 m corresponding to a dwell time of less than 0.07 second. It is clear from these figures that complete stabilization of the produced filaments is not possible in a high-speed combined spinning and stretching process, and the desired properties of low shrink combined with low extension and high elasticity cannot be obtained.

The dwell times required for adequate stabilization can only be obtained on an industrial scale if the speed of the yarn or tow to be treated is reduced to a few 100 m/min. Stretching units for stretching individual filaments or yarns which work under these conditions can lead to fully set and thermostable filaments. For economic reasons, however, especially low-shrink industrial filaments are prepared on so-called tow drawing lines, where a large number of filaments are side by side in sheet form and pass between systems of rolls, being stretched and shrunk. The filaments according to the invention are also preferably prepared on such a tow road stretching apparatus. The systematic structure of such a tow road is reproduced in FIG. 3.

As previously stated above, the stretching ratio for preparing high-strength filaments needs to be as high as possible in order to reach the strength inherent to the filaments as completely as possible. According to the invention, the stretching ratio is at least 90% of the maximum cold stretching ratio ($SR_{max}$), which is determined as follows:

A filament is ruptured at room temperature in a tensile tester using a clamping length of 100 mm and a clamp speed of 400 m/min. This gives $$SR_{max} = \frac{\text{maximum tensile force elongation}}{100} + 1$$

A further variable which defines the stretching process is the stretching tension. This stretching tension is a unique function of the stretching ratio, of the stretching temperature and of the dwell time in the stretching zone. The stretching tension is the quotient of the tensile force, measured for example by means of a tensiometer, and the feed yarn linear density reduced by the set stretch ratio.

Figure 4:
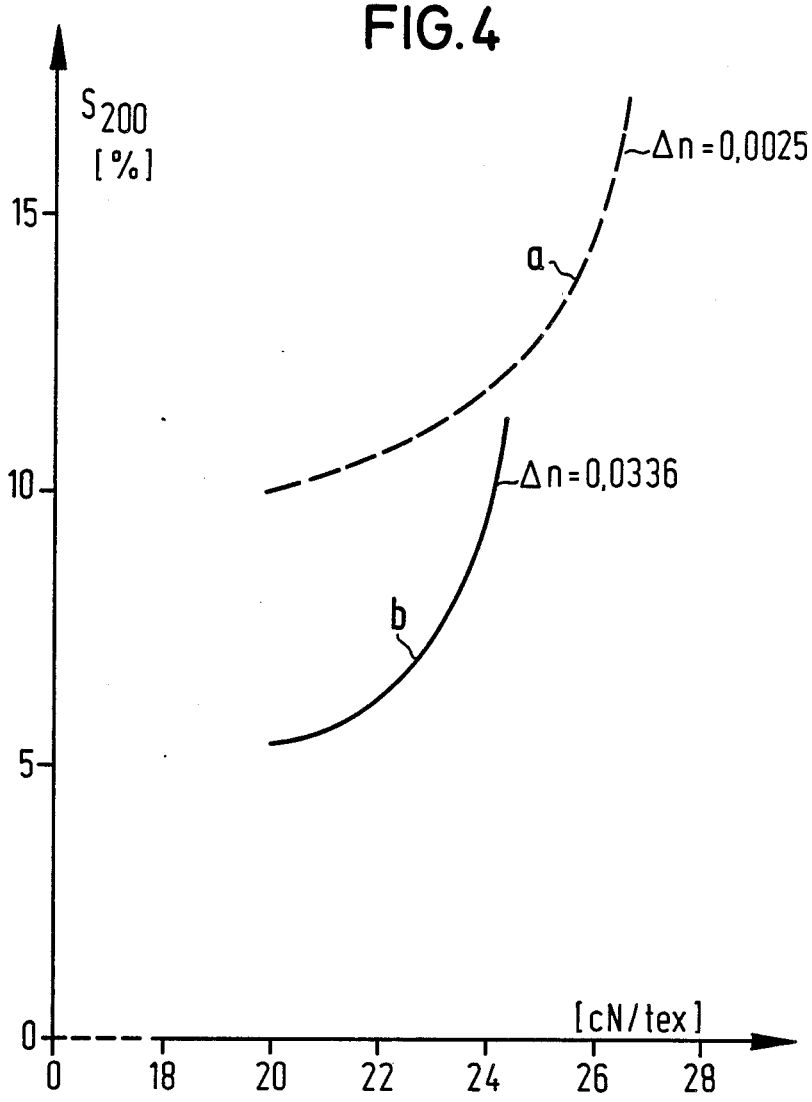
FIG. 4 compares the dependency of shrinkage at 200° C. on the stretching tension of (1) yarn filament having a final bifringence of 0.0025 (curve a) and (2) yarn filament having a bifringence of 0.0336 (curve b).

It has now been found that the stretching tension is very important for meeting the shrinkage properties which are desired according to the invention for the filaments after stretching. The internal tensions introduced into the filaments by the stretching tension are reflected by the heat shrinkage, as is clear from FIG. 4. This FIG. 4 shows the dependence of shrinkage at 200° C. ($S_{200}$) on the stretching tension of a yarn having a final linear density of 1100 dtex and a birefringence of 0.0025 (curve a). The same process was carried out on a filament having a birefringence of 0.033 and an $SR_{max}$ of 90%, which had been spun with a windup speed of 3000 m/min. The measurements resulted in curve b of FIG. 4.

To obtain a filament having constant extension properties, which are the result of the constant stretch ratio, and a very low heat shrinkage, it is desirable to keep the stretching tension as low as possible. Since high stretching tensions also are more prone to cause individual filaments to break, which can make it very difficult to process the filaments into yarns and fabrics, this is a further reason for using the lowest possible stretching tension. In industrial practice it has now been found that stretching tensions within the range between 19 and 23 cN/tex, preferably within the range between 20 and 23 cN/tex, relative to the linear density (count) of the filament at the end of the stretching zone, lead to optimal results. If the stretching tensions are raised by reducing the temperature or by shortening the dwell time, the consequences are not only that a higher heat shrinkage is obtained but also that the number of broken filaments increases. A reduction of the stretching tensions would only be obtainable through further temperature increase, through a slower method of operation or through reducing the stretch ratio. However, a reduction of the stretch ratio needs to be avoided owing to the attendant impairment of the strength values. A slower method of operation and hence an increased dwell time in the stretching zone is only successful when the time for complete stabilization was too short in the faster method of operation. If the time was adequate, a further slowing down does not give a further reduction of stretching tension but only impairs the strength of the filament. An increase in the temperature is only possible up to the point at which the maximum tensile force of the filaments or the yarn is not yet exceeded at these high temperatures. This thus leaves only a relatively small range in which optimal stretching can be carried out. This range is within the abovementioned range between 19 and 23 or 20 to 23 cN/tex.

If these experiences gained with filaments of low preorientation about the dependence of stretching tension, stretch ratio, stretching temperature and dwell time, then, are to be transferred to filaments of higher preorientation, problems are encountered. If filaments of higher preorientation are stretched under the temperature and dwell time conditions which are optimal for filaments of low orientation, it is found that stretch ratios which amount to 90% of $SR_{max}$ give rise to much stretching tensions, which then also cause the abovementioned difficulties. It is thus necessary to reduce the stretch ratio if satisfactory filaments are to be obtained. This reduction, however, has the consequence that the filament strengths are markedly reduced and the filaments nevertheless still have high shrinkage values. Such an effect is clearly evident in the later comparative Examples 4 against 5 and 12 against 13.

It has now been found, surprisingly, that filaments of high preorientation can be stretched at temperatures which are too high for safely stretching filaments of low preorientation, since they break. However, by increasing the temperature at which the stretch is carried out it is possible to restore stretching tensions to between 19 and 23, preferably 20 and 23 cN/tex. This markedly increased stretching temperature in the case of filaments of higher preorientation leads to filaments having particularly favorable shrinkage properties and again permits the use of a stretch ratio which amounts to at least 90% of the maximum cold stretch ratio ($SR_{max}$).

With the process according to the invention the specification of a stretching temperature would likewise not be meaningful, since such temperatures would be for example the temperature of the heating medium, instead of the only important temperature, namely that of the filament. The measurement of filament temperatures within a furnace is not feasible. And on leaving the furnace the filament begins to cool down very rapidly. Only by measuring the filament temperature at various distances from the exit from the heating zone of the furnace and applying the approximation formula given by Kaufmann in "Faserforschung und Textiltechnik" 28 (5), pages 297–301 (1977) is it possible to extrapolate the true filament temperatures at the end of the furnace. In the case of a furnace with a cross-flow of hot air, it is possible to infer that the filament has taken on the temperature of the air flow before leaving the furnace only if the dwell time in the furnace was sufficiently long. In a furnace which is heated by infrared radiators, a measurement is not possible at all, since, inside the furnace, even thermosensors which are close to the filaments are, as a result of the radiation, at a different temperature than the filaments. However, such sensors can be used to give satisfactory control of the intensity of radiation and also of the temperature of the hot air inside a furnace. It is shown in the examples what the temperature settings need to be in order to obtain corresponding effects and that, for characterizing the stretch, it is sufficient to specify the stretching tension and the proportion of the attained maximum stretch ratio.

Figure 3:
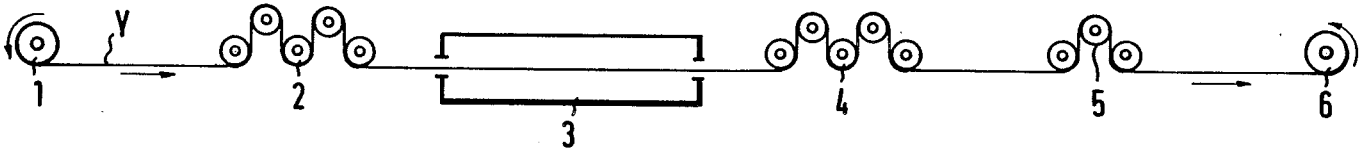
FIG. 3 depicts the structure of an apparatus for stretching large numbers of filaments of the instant invention in side-by-side sheet form.

A schematic representation of a preferred apparatus for carrying out the process according to the invention is shown in FIG. 3.

The filaments are drawn from the bobbins 1 mounted in a creel and are passed together in warp like form to roll unit 2, which comprises 5 to 7 heatable rolls whose surface temperatures are 75° to 100° C., according to filament speed. The filament "warp" then passes through the heated furnace 3, which completely encloses the filament "warp" and then arrives at roll unit 4 which likewise comprises 5 to 7 rolls. The speed of roll unit 4 is higher than that of roll unit 2 by the stretching factor. From there the filaments then pass directly to winding up 6 or they are passed beforehand through roll unit 5 which generally comprises 3 rolls.

The furnace can be heated either by heating its walls electrically or by means of a liquid heat carrier while at the same time the filaments are met by a flow of hot air, or by heating the filament "warp" with infrared radiators which are mounted in the furnace. Another possibility is heating by means of hot air which flows across the running direction of the filament "warp". If the stretch is followed by relaxation, all this necessitates is that roll unit 4 is heated to an appropriately higher temperature and the relaxation is then allowed between roll unit 4 and roll unit 5 or between roll unit 4 and winding up 6. In the latter case, the relaxation needs to be precisely adjustable between these two aggregates.

Without relaxation, the stretching according to the invention of highly preoriented polyester yarns leads to a heat shrinkage $S_{200}$ of about 6%. These yarns are particularly suitable for use in warplike structures which are given an additional heat treatment before incorporation in a composite article, such as, for example, twisted yarns for car tires, drive belts and conveyor belts.

The temperature, time and tension conditions of the heat treatment then determine the properties of the warplike structures with respect to shrinkage and extensibility. Even after this further heat treatment the materials according to the invention prove superior to those disclosed hitherto. The fully finished warplike structures likewise have better shrinkage, extensibility and elasticity properties than those disclosed hitherto and are superior to them in thermostability and dimensional stability. It has also been found that, compared with the previously disclosed materials, the action of heat can be shorter in order to obtain the final properties of the finished materials. That is, the thermal aftertreatment of the textiles can take place under milder conditions and using shorter dwell times, which is also of advantage with respect to the strength.

In the case of some industrial articles, such as, for example, heating hoses, PVC-coated fabrics and the like, this shrinkage is still too high, since these reinforcing materials are directly vulcanized or coated without further thermal pretreatment. In this case it is necessary to use filaments of even lower shrinkage. These are obtained when roll unit 4 of the stretching line has a surface temperature of more than 200® C. and the filaments are allowed to shrink controllably between roll unit 4 and roll unit 5 or between roll unit 4 and winding up 6.

If filaments from spun material having a low preorientation or filaments which have a higher preorientation but have not been stretched in accordance with the invention are allowed to shrink in this way, it is necessary to allow these filaments to relax to a further degree in order to obtain a low heat shrinkage at 200° C. of about 2 to 3%. That has the previously mentioned consequences that the extensibility rises steeply and the degree of elasticity drops.

With the yarns prepared in accordance with the invention, on the other hand, a high degree of elasticity is obtained even after a relaxation, as is also reflected in a high stability quotient SQ. The yarns according to the invention are suitable not only for use in twisted yarns for, for example, the production of tires etc., which receive a further thermal treatment during latexing, but also—with a relaxation stage downstream of the stretching stage—for use in PVC-coated fabrics etc.

The following examples are to illustrate the process in more detail. They reveal that the filaments according to the invention are only obtained when the conditions of the process according to the invention are complied with. The parts and percentages are by weight, unless otherwise stated.

EXAMPLES

The spun material used for the stretching trials described hereinafter was prepared using known technology, as described hereinafter.

The polyethylene terephthalate granulate used for Examples 1 to 7 and 12 to 14 had a relative solution viscosity in dichloroacetic acid of 2.120. The material used in Examples 8 and 9 had a relative solution viscosity of 1.990 and that used in Example 10 a relative solution viscosity of 2.308. The relative solution viscosity was determined in conventional manner at 25° C. on solutions of 1.0 g of the polymer in 100 ml of dichloroacetic acid by measuring the passage times of the solution through a capillary viscometer and by determining the passage time of the pure solvent under the same conditions. The polyethylene terephthalate granules used were melted in an extruder, and the melt was fed into a spinning pump and spun through a spin pack. The jet plate in this spin pack had in each case 100 holes with a diameter of 0.45 mm each. The filaments emerging from the spinning jets were reheated in the case of the raw materials having a relative solution viscosity of 2.120 and 2.308 by means of a device, situated below the spinneret plate, of the type described in German Patent 2,115,312 and were subsequently subjected to a cross-flow of air at 26° C. and a speed of 0.5 m/sec. Two such filaments were passed together to a spin-finish applicator, were coated with spin finish and were drawn off and wound up with the speeds indicated in the examples. The filaments were then stretched and partially shrunk under various conditions and on various stretching units, depending on the preorientation of the spun material. The stretching units differed in the type of stretching furnace.

In the examples, "IR" is to be understood as meaning a heating duct in which the filaments were heated by ceramic infrared radiators, and "air" is to be understood as meaning a furnace in which the filaments were heated by means of a cross-flow of hot air. In both cases the indicated temperatures refer to the temperatures of the sensors. In the "IR" furnace the sensors were situated about 15 mm above the filament sheet, while in the "air" furnace they were mounted below the filament sheet and indicated the temperature of the hot air before contact with the filament sheet.

Example 1 indicates the method of stretching a filament of low preorientation. The indicated temperature could not be increased further since otherwise broken ends occurred. In Example 5 the same stretching conditions in terms of dwell time and temperature as in Example 1 were used, but the feed yarn had a high preorientation. A comparison of the values put together in the table below indicates that, owing to the high preorientation, the shrinkage is slightly lower and the stability quotient is insignificantly higher than in Example 1, the advance over the likewise satisfactorily stabilized filament of Example 1 not being large. The values of Example 4, however, show that by increasing the sensor temperature by 20° C. it was possible to obtain a filament which had significantly reduced shrinkage and which safely met all the requirements of the claims. In Example 6 the temperature of the heater was raised to that of Example 4, but by doubling the operating speed the dwell time was halved. This measure resulted in a steep increase in the stretching tension, the values for shrinkage and stability quotient being clearly outside the claimed ranges. This example shows how important it is to comply with the proposed stretching conditions, since otherwise, despite the shrinkage-reducing high preorientation of the spun material, it is only possible to obtain a yarn which is even inferior to conventional filaments and yarns in thermostability. In Examples 8 and 10, the stretching conditions according to the invention are applied to filaments of high preorientation. The filament-forming substances used, however, have different average molecular weights corresponding to different relative solution viscosities.

Examples 7 and 9 feature the use of a process in which the stretching was followed by a shrinking. In both cases, despite the very low heat shrinkage obtained for the yarn materials, the elasticity is still present to virtually 100%, and the claimed stability quotient is also exceeded.

If, on the other hand, an attempt is made, as in Examples 2 and 3, to apply this process to a filament of low preorientation, then, with the same degree of elasticity in Example 2, the heat shrinkage of the yarn material is very much higher than in Example 7. A further relaxation, as shown in Example 3, admittedly has the effect of reducing the value of the heat shrinkage by a small amount, but the value is nonetheless a long way away from the low values of Examples 7 and 9. On the other hand, the reference extension at 54 cN/tex, which has risen to a very high value, and the degree of elasticity $ED_{20}$, which has dropped by a considerable amount, indicate the formation of a marked "shrinkage saddle" in the stress-strain diagram. Example 14 shows that although increasing the preorientation by raising the takeoff speed to a birefringence which is still below the claimed value of 0.025 has the effect of improving the thermostability since the stretching temperature could already be raised by a small amount, it was not possible to obtain the claimed ranges for the physical values of the yarns. Examples 11 to 13 feature the use of a stretching furnace having a crossflow of air. In this case too it is found again that a filament which is in accordance with the invention can only be obtained by raising the stretching temperature which in this case could presumably also be the temperature of the filament at the end of the stretching zone. Increasing the stretching temperature to 250° C. in Example 11 caused constant filament breakages. Even at 245° C. individual tows broke, while others had very many broken filaments.

| Example No. | | 1(x) | 2(x) | 3(x) | 4 | 5(x) | 6(x) | 7 | 8 | 9 | 10 | 11(x) | 12 | 13(x) | 14(x) |
|---|---|---|---|---|---|---|---|---|---|---|---|---|---|---|---|
| relative solution viscosity | | 2.030 | 2.033 | 2.040 | 2.040 | 2.040 | 2.035 | 2.030 | 1.960 | 1.956 | 2.120 | 2.030 | 2.035 | 2.040 | 2.042 |
| Spin output | g/min | 216 | 206 | 199 | 395 | 395 | 395 | 390 | 368 | 353 | 407 | 216 | 395 | 395 | 310 |
| Spin takeoff | m/min | 750 | 750 | 750 | 3000 | 3000 | 3000 | 3000 | 2500 | 2500 | 3500 | 750 | 3000 | 3000 | 1500 |
| Birefringence | $\times 10^{-3}$ | 3.32 | 3.25 | 3.29 | 33.6 | 33.6 | 33.6 | 33.0 | 26.1 | 25.8 | 55.7 | 3.30 | 33.6 | 33.6 | 10.9 |
| maximum stretching ratio $SR_{max}$ | | 5.67 | 5.70 | 5.73 | 2.72 | 2.72 | 2.72 | 2.69 | 2.98 | 3.02 | 2.40 | 5.67 | 2.72 | 2.72 | 4.15 |
| Temperature of roll unit 1 | °C. | 85 | 85 | 85 | 85 | 85 | 93 | 85 | 85 | 85 | 85 | 85 | 85 | 85 | 85 |
| Temperature "IR" | °C. | 285 | 285 | 285 | 305 | 285 | 305 | 305 | 300 | 300 | 310 | — | — | — | 295 |
| Dwell time in furnace | sec | 3.3 | 3.3 | 3.3 | 3.3 | 3.3 | 1.7 | 3.3 | 3.3 | 3.3 | 3.3 | 3.3 | 3.3 | 3.3 | 3.3 |
| Temperature "air" | °C. | — | — | — | — | — | — | — | — | — | — | 242 | 255 | 242 | — |
| Machine stretching ratio | 1: | 5.20 | 5.20 | 5.20 | 2.45 | 2.41 | 2.37 | 2.45 | 2.70 | 2.73 | 2.18 | 5.20 | 2.45 | 2.40 | 3.73 |
| corresponds to % of $SR_{max}$ | | 91.7 | 91.2 | 90.9 | 90.9 | 88.6 | 87.1 | 91.9 | 90.6 | 90.4 | 90.8 | 91.7 | 90.0 | 88.2 | 89.9 |
| Stretching tension | cN/tex | 21.1 | 20.8 | 20.5 | 21.8 | 23.2 | 24.1 | 21.8 | 21.3 | 22.0 | 21.9 | 20.8 | 20.7 | 24.0 | 21.8 |
| Temperature of roll unit 2 | °C. | 100 | 220 | 230 | 100 | 100 | 100 | 220 | 100 | 220 | 100 | 100 | 100 | 100 | 100 |
| allowed relaxation | % | — | 6 | 10 | — | — | — | 6 | — | 6 | — | — | — | — | — |
| total count | dtex | 1132 | 1126 | 1139 | 1115 | 1126 | 1151 | 1130 | 1123 | 1107 | 1103 | 1128 | 1110 | 1120 | 1125 |
| Tenacity | cN/tex | 73.2 | 68.9 | 67.3 | 72.1 | 69.2 | 72.5 | 69.0 | 72.2 | 68.7 | 68.1 | 72.8 | 72.5 | 69.5 | 70.7 |
| maximum tensile force extens. | % | 10.1 | 14.5 | 18.1 | 10.0 | 10.1 | 10.0 | 14.4 | 9.8 | 14.7 | 9.2 | 10.3 | 10.2 | 10.0 | 9.5 |
| Extension at 54 cN/tex ($D_{54}$) | % | 5.7 | 10.4 | 14.2 | 6.0 | 5.9 | 5.9 | 11.0 | 6.1 | 10.9 | 6.1 | 6.0 | 6.2 | 5.8 | 6.1 |
| Heat shrinkage | $S_{200}$ % | 9.0 | 5.2 | 3.2 | 5.9 | 8.1 | 10.8 | 1.7 | 6.0 | 1.8 | 5.0 | 9.1 | 5.5 | 8.3 | 7.9 |
| Degree of elasticity $ED_{20}$ at 20 cN/tex | % | 100 | 98 | 67 | 100 | 100 | 100 | 97 | 100 | 98 | 100 | 100 | 100 | 100 | 100 |
| Stability quotient | SQ | 6.8 | 6.3 | 3.9 | 8.4 | 7.1 | 6.0 | 7.6 | 8.3 | 7.7 | 7.9 | 6.6 | 8.5 | 7.1 | 7.1 |
| Crystallinity | % | 57.8 | 60.8 | 61.8 | 61.3 | 60.7 | 60.4 | 62.5 | 61.8 | 61.6 | 62.3 | 60.9 | 61.3 | 60.4 | 61.0 |

(x)Comparative examples

Example 11 was performed on a feed yarn of low preorientation which had a birefringence of only 0.0033.

I claim:

1. An untwisted, high strength polyester yarn for industrial use which has been hot-stretched in one step comprising a filament-forming substance having a high average molecular weight corresponding to a relative solution viscosity (1.0 g of polymer in 100 ml of dichloroacetic acid at 25° C.) of about 1.90 to about 2.20 and a crystallinity of about 57 to about 65%, the yarn having a heat shrinkage $S_{200}$ of less than 7%, a degree of elasticity $ED_{20}$ of at least 90%, and a stability quotient SQ of at least 7.5.

2. The yarn as claimed in claim 1, wherein the filament-forming substance comprises a polyethylene terephthalate which may contain up to 2% by weight of other comonomer units.

3. The yarn as claimed in claim 1, having a heat shrinkage $S_{200}$ of less than 3%.

4. The yarn as claimed in claim 1, having a crystallinity of about 60 to 63%.

5. A process for preparing a yarn as claimed in claim 1, which comprises subjecting a polyester feed yarn of high preorientation corresponding to a birefringence of at least 0.025 and an average molecular weight corresponding to a relative viscosity (1.0 g of polymer in 100 ml of dichloroacetic acid at 25° C.) of about 1.9 to about 2.20 to a stretching at high temperatures using a stretch ratio of at least 90% of the maximum cold stretch ratio and a stretching tension between 19 and 23 cN/tex.

6. The process as claimed in claim 5, wherein the stretching tension is 20 to 23 cN/tex.

7. The yarn as claimed in claim 3, having a heat shrinkage $S_{200}$ of less than 2%.

* * * * *

UNITED STATES PATENT AND TRADEMARK OFFICE

CERTIFICATE OF CORRECTION

PATENT NO. : 4,973,657

DATED : November 27, 1990

INVENTOR(S) : Hans Thaler

It is certified that error appears in the above-identified patent and that said Letters Patent is hereby corrected as shown below:

Column 4, line 17, after "than" (first occurrence) insert --3%,--.

Column 8, line 7, after "much" insert --higher--.

Signed and Sealed this

Nineteenth Day of May, 1992

*Attest:*

DOUGLAS B. COMER

*Attesting Officer*

*Acting Commissioner of Patents and Trademarks*